United States Patent [19]

Follows et al.

[11] 4,313,693

[45] Feb. 2, 1982

[54] RAIN GUTTER JOINT

[76] Inventors: James S. Follows, 12848 Southridge Dr., Surrey, B.C.; Douglas Grant, 540 Newcroft Pl., West Vancouver, B.C., both of Canada

[21] Appl. No.: 112,625

[22] Filed: Jan. 16, 1980

[51] Int. Cl.[3] ..... E04D 13/00; E04D 13/04

[52] U.S. Cl. ..... 405/121; 52/11

[58] Field of Search ..... 405/119–124; 52/11–16, 384, 385, 395, 397, 393; 248/48.2; D8/380, 366; D23/45; 210/474, 475

[56] References Cited

U.S. PATENT DOCUMENTS

| | | | |
|---|---|---|---|
| 2,873,700 | 2/1959 | Heier | 52/12 |
| 3,299,641 | 1/1967 | Heagler et al. | 405/122 X |
| 3,545,144 | 12/1970 | Sickler | 52/11 |

FOREIGN PATENT DOCUMENTS

| | | | |
|---|---|---|---|
| 74887 | 3/1976 | Australia | 248/48.2 |
| 1384771 | 11/1964 | France | 52/11 |
| 1076753 | 7/1967 | United Kingdom | 52/11 |

*Primary Examiner*—Dennis L. Taylor

*Attorney, Agent, or Firm*—Christensen, O'Connor, Johnson & Kindness

[57] ABSTRACT

A rain gutter joint includes upper and lower clamping members between which adjacent ends of a pair of rain gutter troughs are clamped and joined together. Cooperable pin and socket assemblies in the clamping members enable the members to be fastened with conventional fasteners without exposing such fasteners to standing water in the rain gutter. The joint apparatus accommodates thermal expansion and contraction of the rain gutter troughs and yet also provides a superior watertight seal between the troughs.

10 Claims, 7 Drawing Figures

Fig. 1.
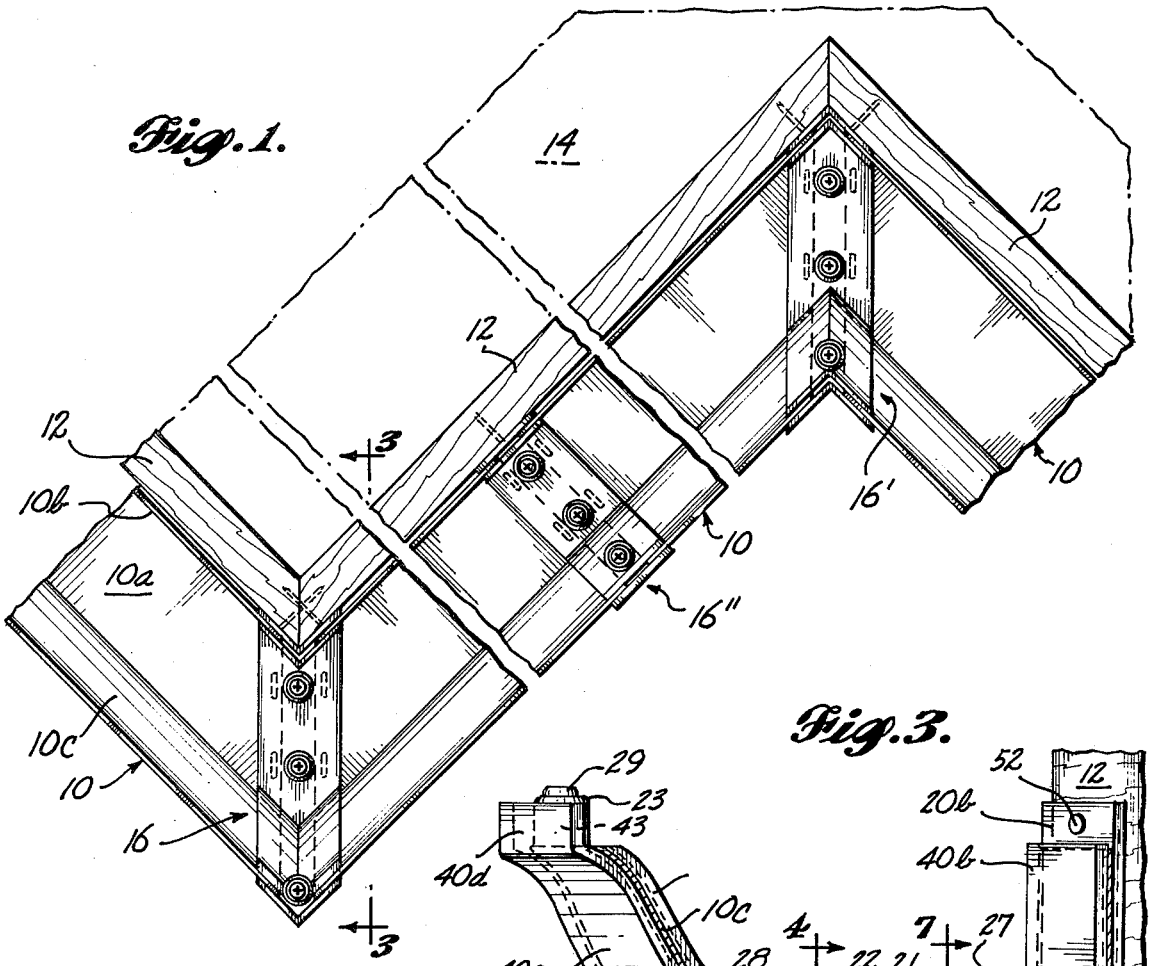
Fig. 3.
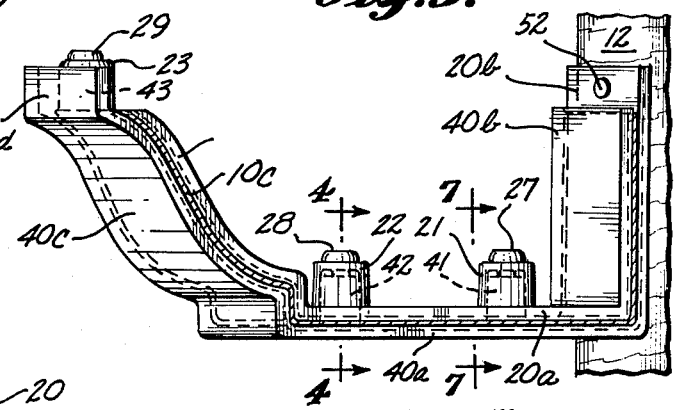
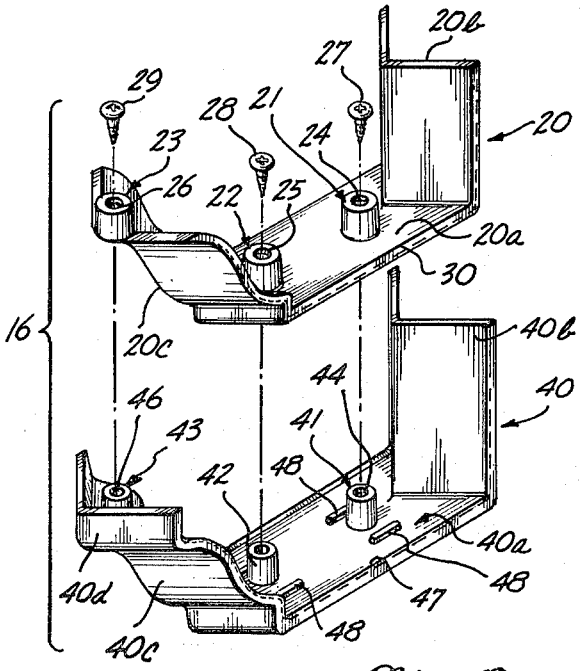
Fig. 2.
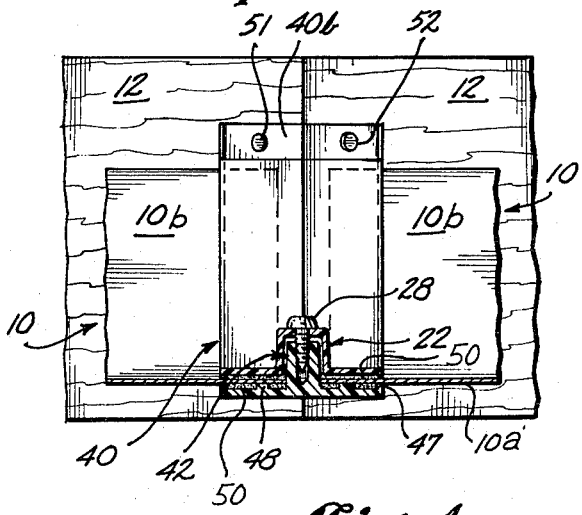
Fig. 4.

RAIN GUTTER JOINT

BACKGROUND OF THE INVENTION

The present invention relates generally to rain gutters, and more particularly to connecting and supporting devices for rain gutters installed on residential and other small buildings.

Rain gutters for residential buildings and the like are typically made of roll-formed aluminum gutter troughs installed along the eaves of the roof. Various accessory devices are used to install the rain gutter troughs and their associated downspouts to the eaves. For example, devices known as gutter hangers are used to attach the gutter troughs to fascia boards running along the eaves. Various other devices, generally known in the trade as corner miters, are used to connect the ends of gutter troughs where they intersect at a corner of a roof. It is an improved device of the latter type to which the present invention is addressed.

Two types of corner miters have been widely used in the past to join roll-formed aluminum gutters. The first type is referred to as a miter strip and consists simply of an aluminum strip which extends diagonally outward from a corner of an eave and conformably underlies and connects the ends of the two gutter troughs intersecting at the corner. The gutter troughs are each cut at a 45° angle and positioned such that their end edges are aligned parallel to and spaced slightly from one another and overlie the miter strip. After the gutter troughs have been placed in position along the fascia boards, holes are drilled through both the miter strip and the overlying end portions of the troughs, and rivets are installed in the holes to secure the miter strip to the trough ends. The miter strip may itself be additionally attached to the corner of the eave to thereby provide some support to the gutter trough ends. A silicone caulking compound is usually applied between the upper surface of the miter strip and the lower surfaces of the trough ends just prior to riveting to provide a waterproof seal at the gutter corner.

The second type of corner miter commonly available heretofore is commonly referred to as a box miter and consists of a prefabricated corner gutter trough having a cross-sectional configuration substantially the same as that of the straight gutter troughs. The box miter is attachable to the corner of the eave and extends several inches in each direction from the corner along the fascia boards of the eaves. The ends of the box miter may thus abut or overlap the ends of the straight gutter troughs attached to the fascia boards. The box miter is typically joined to the ends of the gutter troughs by simply overlapping and riveting the gutter troughs to the box miter. Silicone caulking is also typically used in this type of joint.

Where a pair of straight aluminum gutter troughs are to be joined at an intermediate point along an eave where they abut end-on, they are generally connected by simply overlapping their adjacent ends, drilling holes through the overlapping end portions, applying a caulking compound, and riveting the ends together.

The above-described corner miters of either the miter strip or box miter types, as well as the method of joining them to gutter trough ends by riveting, have proven somewhat unsatisfactory for several reasons. First, riveting of the gutter troughs to the corner miters does not provide any allowance for longitudinal thermal expansion and contraction of the gutter troughs. This is not a trivial consideration, inasmuch as gutter troughs commonly reach to considerable lengths and therefore undergo substantial lengthwise contraction and expansion on a daily basis by exposure to diurnal ambient temperature changes. With conventional corner miters, expansion and contraction of the gutter troughs impose longitudinal stresses on the corner miters and lead to deterioration and loosening of the rivets, with consequent leaking of the joint. Leaking may occur either through the rivet holes as the rivets become loosened, or between the overlapping aluminum pieces as the caulking between them hardens, deteriorates and cracks. In either case, once leaking has begun it accelerates corrosion of the aluminum parts as well as deterioration of the caulking compound, and thereby further reduces the useful life of the rain gutter.

This is a particularly severe problem in the case of professionally installed roll-formed aluminum gutters wherein long, one-piece aluminum gutters are custom made for the particular application at hand. Such gutters are roll-formed at the site of installation from rolls of continuous aluminum stripping and are typically made as long as necessary to cover the entire length of the fascia board at hand, that is, from one corner of the eave to the next. Because of the rather long lengths of these gutter troughs, the longitudinal stresses due to thermal expansion and contraction are proportionately greater than those in shorter, off-the-shelf gutter troughs.

Another problem with conventional corner miters is that they require drilling and riveting of the pieces at the site of installation, thus requiring appropriate specialized tools and techniques. Moreover, the actual riveting must be done with the gutter troughs placed in position along the eaves, thereby making the job awkward and occasionally dangerous.

Accordingly, it is a general object of the present invention to provide a joint device for rain gutters which provides a watertight seal and yet allows for longitudinal thermal expansion and contraction of the rain gutter trough. It is a further object of the present invention to provide a joint device which is free of holes which pass through the water-bearing surface of the gutter. It is yet another object of the present invention to achieve the foregoing objects and yet also provide a means for applying a greater amount of caulking compound on both top and bottom surfaces of the rain gutter troughs, and also protect such caulking compound from exposure to air and water so as to lengthen the effective life of the caulking compound. Finally, it is also an object to facilitate and simplify the installation of rain gutter troughs.

SUMMARY OF THE INVENTION

In accordance with the present invention, a connecting and supporting apparatus for joining a pair of rain gutter troughs consists of upper and lower clamping members which conformably engage the upper and lower surfaces, respectively, of the adjacent gutter trough ends. The lower and upper surfaces, respectively, of the upper and lower members conform generally with the profile of the gutter trough ends. The joint is made watertight by application of caulking compound to both top and bottom surfaces of the gutter trough ends.

The upper and lower clamping members are engageable about the trough ends by means of cooperable socket and pin assemblies. Pin assemblies extending upwardly from the upper surface of the lower clamping member are insertable into cooperable socket members opening downwardly from the upper clamping members. The pin and socket assemblies are generally centered on the midlines of the respective clamping members. Fastening devices, typically screws, protrude through the upper ends of the sockets on the upper clamping member and into the pins of the lower clamping member to thereby clamp the members together with the gutter trough ends clamped between them. The sockets of the upper clamping member are raised above the water-bearing surface of the upper member such that the screws are never exposed to standing water at the bottom of the gutter. Consequently, there can be no leakage through the holes and the effective life of the screws is extended.

Although the present invention is primarily of application as a corner joint apparatus where gutter troughs intersect orthogonally, it may be equally well applied as a connecting device for gutter troughs abutting end-on. Moreover, the device may be used in both outside and inside corners along the perimeter of a roofline. The advantages of the present invention will become more apparent by reference to the accompanying FIGURES and the following detailed description of the preferred embodiment.

BRIEF DESCRIPTION OF THE DRAWINGS

FIG. 1 is a plan view of the preferred embodiment of the present invention as it is adapted to inside and outside corners of a roofline, as well as at an intermediate point where end portions of the rain gutter troughs meet.

FIG. 2 is an exploded isometric view of a corner joint apparatus for an outside corner of a roofline.

FIG. 3 is a side view taken along line 3—3 of FIG. 1.

FIG. 4 is an end view taken along line 4—4 of FIG. 3.

DESCRIPTION OF THE PREFERRED EMBODIMENT

Figure 5:
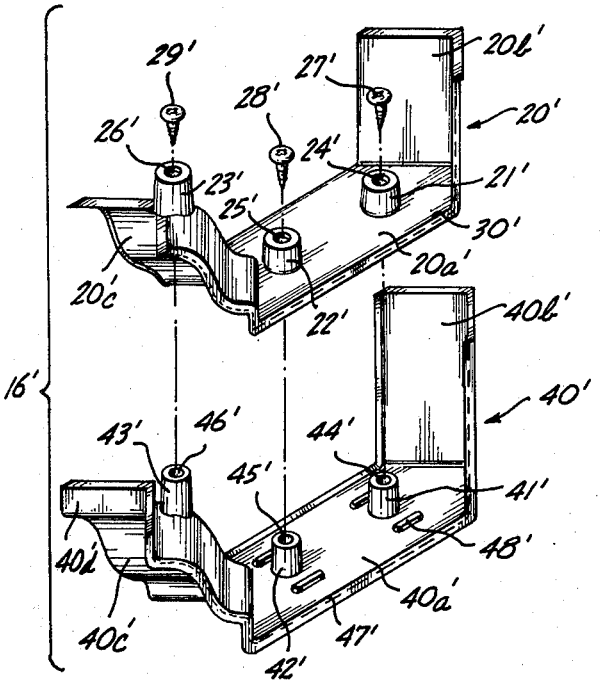
FIG. 5 is an exploded isometric view of a corner joint apparatus adapted for an inside corner of a roofline.

The preferred embodiment of the rain gutter joint of the present invention is described herein by reference to the embodiments illustrated in the accompanying FIGURES. Three embodiments of the joint apparatus are illustrated in FIG. 1 as they are employed to connect adjacent sections of rain gutter troughs 10 to one another and also attach the troughs 10 to the outer surfaces of fascia boards 12 along the eave of the roof 14. The joint may be employed at an outside corner of the eave, as illustrated by joint 16 in FIG. 1, as well as at an inside corner, as indicated by joint 16'. Additionally, the joint apparatus may be employed at an intermediate point along the roofline to connect rain gutter troughs 10 meeting end-on, as illustrated by joint 16''. It will be understood that the principle of operation is essentially identical for each of the three illustrated joints 16, 16' and 16'', and that they differ only to the extent that their configurations are adapted to their respective positions on the eave. Accordingly, the invention may be adequately understood by reference to the following more detailed description of the outside corner joint 16 shown in FIG. 1.

Referring to FIG. 2, the joint apparatus 16 for an outside corner of an eave includes upper and lower clamping plates 20 and 40, respectively. The upper and lower plates 20 and 40 consist of injection molded strips of polyvinyl chloride (PVC) plastic shaped to conform with the upper and lower surfaces of the gutter trough 10. The upper clamping plate 20 includes a flat bottom portion **20*a* which is generally horizontal when installed and which forms the water bearing surface of the joint 16. A right-angle portion 20*b* extends upwardly from the rear of the bottom portion 20*a* so as to be in generally parallel alignment with the outside corner of the eave defined by the intersecting fascia boards 12. At the opposite end of the upper clamping plate 20 from the right-angle portion 20*b* is a curviplanar portion 20*c* extending upwardly and outwardly from the forward, or outer edge of the bottom portion 20*a***.

It will be seen from FIGS. 1 through 4 that the configuration of the upper clamping plate 20 is constructed to conform with the configurations of each of the gutter troughs 10. The gutter troughs 10 each include a floor portion **10*a* which is generally horizontal when the gutter trough is installed, a vertical wall portion 10*b* which is positioned flush against the fascia boards 12, and an outer, curviplanar wall portion 10*c*. The upper clamping plate 20 is formed such that, when a pair of gutter troughs 10 are each cut at a 45° angle with respect to their longitudinal axes and placed at right angles with respect to one another with their end edges parallel, the curviplanar portion 20*c* of the upper clamping plate conformably rests upon the curviplanar walls 10*c* of the gutters 10, the bottom portion 20*a* rests upon the floor portions 10*a* of the gutter troughs 10, and the right-angle portion 20*b* of the upper clamping plate 20 conformably rests against the respective vertical walls 10*b* of the gutter troughs 10**.

The upper clamping plate 20 is symmetrical about a vertical plane passing through the midline of the bottom portion **20*a* and bisecting the right-angle portion 20*b* and the curviplanar portion 20*c*. That is, the upper clamping plate 20, when installed on the fascia board 12**, is symmetrical about a vertical plane extending diagonally outwardly from the corner of the eave.

The upper clamping plate 20 further includes three integrally formed cylindrical sockets 21, 22 and 23. Sockets 21 and 22 protrude upwardly from the upper surface of the bottom portion **20*a* and open downwardly from the bottom surface of bottom portion 20*a*. Socket 23 is positioned at the outer tip of the curviplanar portion 20*c* and opens downwardly therefrom. The sockets 21, 22 and 23 include apertures 24, 25 and 26, respectively, centered on the upper end surfaces thereof for insertion of fastening screws 27, 28 and 29**, respectively.

The upper clamping plate 20 further includes a continuous peripheral lower lip 30. The lip 30 extends downwardly from the opposite side edges of the bottom surface **20*a*, extends generally rearwardly from the top edge and the opposite vertical edges of the right-angle portion 20*b*, and extends generally outwardly from the opposite side edges of the curviplanar portion 20*c*. The function of the peripheral lip 30** is more fully described below.

The bottom clamping plate 40 is generally configured to underlie the upper clamping plate 20 and snugly engage the ends of a pair of gutter troughs 10 inserted between the upper and lower plates 20 and 40. More specifically, the lower clamping plate 40 includes a bottom portion 40*a*, an upright right-angle portion 40*b* extending upwardly from the rear edge of the bottom portion 40*a*, and a curviplanar portion 40*c* extending upwardly and outwardly from the forward, or outer edge of the bottom portion 40*a*. At the upper edge of the curviplanar portion 40*c* is a short right-angle portion 40*d* extending upwardly in generally parallel alignment with the right-angle portion 40*b*.

The lower clamping plate 40 further includes three pins 41, 42 and 43. Pins 41 and 42 are integrally formed with the bottom portion 40*a* and protrude upwardly from the upper surface thereof. Pin 43 protrudes upwardly from the upper surface of the curviplanar 40*c* immediately adjacent the short right-angle portion 40*d*. The pins 41, 42 and 43 are aligned with one another and are centered on the midline of the lower clamping plate 40, that is along a line through which a vertical plane of symmetry passes bisecting each of the portions 40*a*, 40*b* and 40*c*. The pins 41, 42 and 43 are further positioned to be cooperably engageable in the sockets 21, 22 and 23, respectively. The pins 41, 42 and 43 further include holes 44, 45 and 46 for receiving the fastening screws 27, 28 and 29. The axial lengths of the pins 41, 42 and 43 are slightly less than the axial lengths of the interior cylindrical chambers of the sockets 21, 22 and 23, such that the upper end surfaces of the pins 41, 42 and 43 are slightly spaced from the upper interior end surfaces of the sockets 21, 22 and 23 when the plates 20 and 40 are clamped together about the ends of a pair of gutter troughs 10. Such spacing between the interior lower surfaces of the ends of the sockets 21, 22 and 23 and the top surfaces of the pins 41, 42 and 43 results in force applied by the fastening screws 27, 28, and 29 being translated into clamping force between the lower surfaces of the plate 20 and the upper surfaces of the plate 40.

The lower clamping plate 40 further includes a peripheral lip 47. The peripheral lip 47 is approximately 1/16th of an inch wide and extends upwardly from the edges of the bottom portion 40*a*. The peripheral lip 47 further extends generally forwardly from the opposite vertical edges of the right-angle portion 40*b*, and generally inwardly from the side edges of the curviplanar portion 43. The lower clamping plate 40 further includes four spacers 48 integrally formed in the upper surface of the bottom portion 40*a* and extending upwardly therefrom.

Figure 7:
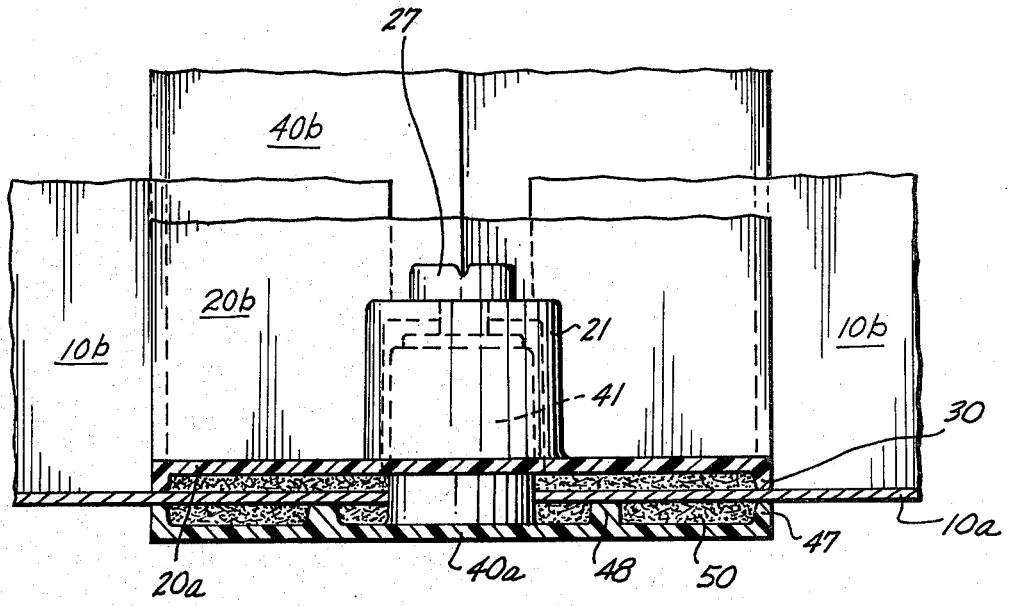
FIG. 7 is a sectional view taken along line 7—7 of FIG. 3.

Referring to FIGS. 3, 4 and 7, the joint 16 in assembly is clamped about the ends of a pair of rain gutter troughs 10 intersecting at a corner of an eave. The rain gutter troughs 10 are each cut at a 45° angle and their cut end edges are positioned parallel to one another and spaced apart by a distance approximately corresponding to the width of the sockets 21, 22 and 23. The end edges of the troughs 10 thus abut against the sockets 21, 22 and 23. The outer curviplanar walls 10*c* of the rain gutter troughs 10 are enclosed between the left and right halves of the curviplanar portions 20*c* and 40*c* of the upper and lower clamping plates 20 and 40, respectively. The floor portions 10*a* are likewise clamped between the flat bottom portions 20*a* and 40*a*, and the rear wall portions 10*b* are clamped between the upright right-angle portions 20*b* and 40b.

Referring to FIGS. 3 and 7, it will be noted that the peripheral lips 30 and 47, as well as the spacers 48, operate to slightly space the bottom portions 20*a* and 40*a* from the upper and lower surfaces of the floor portions 10*a* of the gutter trough 10. The peripheral lips 30 and 47 likewise space the right-angle portions 20*b* and 40*b* and the curviplanar portions 20*c* and 40*c* from the rear walls 10*b* and the curviplanar walls 10*c*, respectively, of the gutter troughs 10. The resulting enclosed space is filled with a silicone caulking compound 50. The caulking compound 50 may thus be applied on both the upper and lower sides of the gutter troughs 10. The peripheral lips 30 and 47 act to minimize exposure of the caulking compound 50 to the elements and yet do not impair lateral contraction and expansion of the gutter troughs 10. The gutter troughs 10 may thus thermally expand and contract within the joint 16 and yet retain a watertight seal with the joint 16. Because the caulking compound 50 is well protected from the elements, the caulking compound 50 retains its elasticity for a relatively long period of time and thereby maintains the watertight seal at the joint. Also, the pins and sockets operate to keep the fastening screws above the surface of the bottom portion 20*a* of the upper clamping plate and thereby prevent water from leaking around the fastening screws and causing deterioration of the caulking compound 50 and leaking of the joint.

The right-angle portion 40*b* of the lower clamping plate 40 is somewhat longer than the corresponding right-angle portion 20*b* of upper clamping plate 20. As seen in FIGS. 3 and 4, this enables the right-angle portion 40*b* to be nailed to the fascia board 12 by a pair of nails 51 and 52 to thereby lend support to the ends of the gutter troughs 10.

Polyvinyl chloride plastic is the preferred material for construction of the clamping plates 20 and 40 for at least two reasons. Firstly, it is known that PVC exhibits superior durability over long periods of time against the adverse effects of exposure to weathering and sunlight. Specifically, PVC may be easily rendered resistant to deterioration by ultraviolet radiation by the addition of ultraviolet inhibiters. Secondly, PVC plastic is sufficiently flexible that the nails 51 and 52 may be driven directly through the right-angle portion 40*b* of the lower clamping plate 40 without cracking or fracturing of the plastic material. The PVC plastic is nevertheless sufficiently rigid to provide structural support to the ends of the gutter troughs 10. Other plastic materials used in such a structure would require predrilling of nail holes to ensure against cracking or fracturing.

FIG. 5 illustrates a joint 16' for installation on an inside corner of an eave. The structure and function of the joint 16' is generally similar to the structure and function of the joint 16 except insofar as necessary to adapt the joint 16' to the inside corner. The features of the joint 16' which are analogous to features of the joint 16 are identified by like-numbered, primed numerals.

Figure 6:
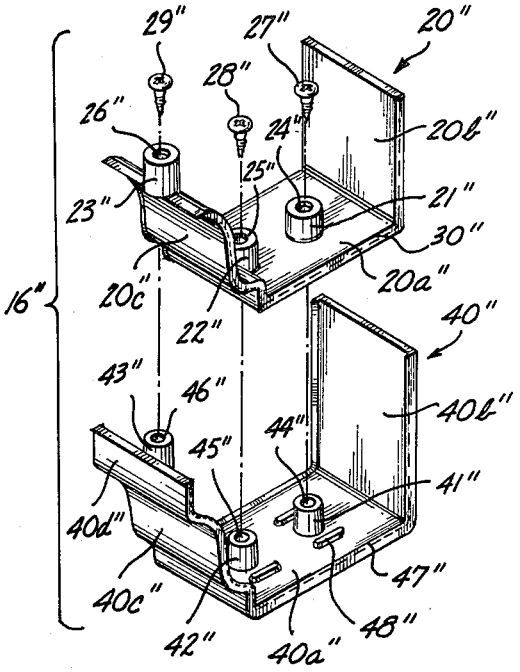
FIG. 6 is an exploded isometric view of a joint apparatus for gutter troughs abutting longitudinally.

The joint 16'' illustrated in FIG. 6 is likewise similar in structure to the joint 16 and 16' except insofar as it is adapted to be installed in the middle of an eave to connect two rain gutter troughs 10 intersecting end-on. The notable difference between the joint 16'' and the previously described joints 16 and 16' is the presence of planar wall portions 20*b*'' and 40*b*'' instead of the analogous right-angle portions of the joints 16 and 16'. The features of the joint 16'' which are analogous to the previously-described features of 16 and 16' are identified by like-numbered, double-primed reference numerals. The joint 16'' will find greater application where gutter troughs of fixed lengths must be used, as opposed to continuously formed, custom-made gutter troughs. For example, the joint 16″ illustrated in FIG. 6 is likely to be applied more frequently by individual homeowners or other persons not ordinarily having available on-site, professional roll-forming machinery. In such cases, precut rain gutter troughs will normally be purchased in fixed lengths and connected as needed by joints 16″ of the type illustrated in FIG. 6.

Although the present invention has been described and illustrated by reference to a preferred embodiment, it will be understood that various alterations, modifications and substitutions which may be apparent to one skilled in the art may be made without departing from the essential spirit of the invention. Accordingly, the scope of the invention is defined by the following claims.

The embodiments of the invention in which an exclusive property or privilege is claimed are defined as follows:

1. A rain gutter joint for connecting a pair of rain gutter troughs that terminate at trough ends adjacent one another, said joint comprising an upper clamping member and a lower clamping member, said upper clamping member having a lower surface cooperably conformable with the upper surfaces of said rain gutter troughs, and said lower clamping member having an upper surface cooperably conformable with the lower surfaces of said troughs, said lower clamping member having a plurality of raised pins extending upwardly from said upper surface of said lower clamping member along a substantially central midline of said lower clamping member, said upper clamping member having a plurality of integral sockets formed to cooperably receive said pins of said lower clamping member, said sockets extending upwardly from said upper clamping member and opening downwardly on said lower surface of said upper clamping member, and fastening means for fastening said pins in said sockets by exerting axial tensile force tending to draw said pins into said sockets.

2. The rain gutter joint defined in claim 1 wherein said pins are shorter in their longitudinal dimension than the interior longitudinal dimension of said sockets, the tensile force exerted by said fastening means between said sockets and said pins thereby being translated into compressional force clamping said gutter trough ends between said clamping members.

3. The rain gutter joint defined in claims 1 or 2 wherein said upper and lower clamping members each further comprise a peripheral lip along the opposite edges of the lower and upper surfaces of said upper and lower clamping members, respectively, said peripheral lips of said upper clamping member extending toward said peripheral lips of said lower clamping member, for enclosing caulking compound applied between said gutter trough ends and said clamping members and minimizing the exposure of said caulking compound to the weather, thereby maintaining the caulking compound in a plastic state whereby longitudinal thermal contraction and expansion of said gutter troughs is accommodated.

4. The rain gutter joint defined in claim 3 wherein said upper and lower clamping members are composed of polyvinyl chloride.

5. The rain gutter joint defined in claim 4 wherein each of said upper and lower clamping members includes a substantially planar bottom portion having first and second ends, an upright right-angle portion extending upwardly from said first end of said floor portion, and a curviplanar portion extending upwardly and outwardly from said second end of said floor portion.

6. The rain gutter joint defined in claim 5 wherein said upper clamping member includes first and second sockets extending upwardly from said bottom portion of said upper clamping member and a third socket extending upwardly from said curviplanar portion of said upper clamping member, said lower clamping member including first and second pins extending upwardly from said bottom portion of said lower clamping member and a third pin extending upwardly from said curviplanar portion of said lower clamping member, said pins being cooperable respectively with said sockets for engaging said upper and lower clamping members about the ends of a pair of rain gutter troughs interposed therebetween.

7. The rain gutter joint defined in claim 6 wherein said upright right-angle portion of said lower clamping member is longer than said upright right-angle portion of said upper clamping member to thereby provide an area of said right-angle portion of said lower clamping member which can be fastened to fascia boards of an eave after engagement of said upper and lower clamping members.

8. The rain gutter joint defined in claim 4 wherein each of said upper and lower clamping members includes a substantially planar bottom portion having first and second ends, an upright planar portion extending upwardly from said first end of said floor portion, and a curviplanar portion extending upwardly and outwardly from said second end of said floor portion.

9. The rain gutter joint defined in claim 8 wherein said upper clamping member includes first and second sockets extending upwardly from said bottom portion of said upper clamping member and a third socket extending upwardly from said curviplanar portion of said upper clamping member, said lower clamping member including first and second pins extending upwardly from said bottom portion of said lower clamping member and a third pin extending upwardly from said curviplanar portion of said lower clamping member, said pins being cooperable respectively with said sockets for engaging said upper and lower clamping members about the ends of a pair of rain gutter troughs interposed therebetween.

10. The rain gutter joint defined in claim 9 wherein said upright planar portion of said lower clamping member is longer than said uprignt planar portion of said upper clamping member to thereby provide an area of said planar portion of said lower clamping member which can be fastened to fascia boards of an eave after engagement of said upper and lower clamping members.

* * * * *